US006875120B1

(12) United States Patent
Ellis

(10) Patent No.: US 6,875,120 B1
(45) Date of Patent: Apr. 5, 2005

(54) SHOT CALCULATOR FOR BILLIARDS

(76) Inventor: Clyde B. Ellis, 335 Coleman La., Spencer, VA (US) 24165

( * ) Notice: Subject to any disclaimer, the term of this patent is extended or adjusted under 35 U.S.C. 154(b) by 0 days.

(21) Appl. No.: 10/689,129

(22) Filed: Oct. 20, 2003

(51) Int. Cl.[7] ..... A63D 15/00; A63D 15/02

(52) U.S. Cl. ..... 473/2; 473/4; 434/247; D21/782; 33/430; 33/465

(58) Field of Search ..... 473/1–4; 33/430, 33/465, 289, 285; D21/782

(56) References Cited

U.S. PATENT DOCUMENTS

| | | | | | |
|---|---|---|---|---|---|
| 1,297,815 | A | | 3/1919 | Englehart | |
| 2,122,440 | A | * | 7/1938 | Samuels | 33/430 |
| 2,440,438 | A | * | 4/1948 | Frink | 235/61 GM |
| 2,504,532 | A | * | 4/1950 | Kahan | 235/89 R |
| 2,537,228 | A | | 1/1951 | Matson | |
| 3,220,122 | A | * | 11/1965 | Miller | 434/247 |
| 3,299,537 | A | * | 1/1967 | Franks | 434/247 |
| 3,410,555 | A | * | 11/1968 | Murch | 473/2 |
| 3,463,593 | A | | 8/1969 | Horan | |
| 3,711,091 | A | | 1/1973 | Dixon | |
| 3,789,507 | A | * | 2/1974 | Murray, Jr. | 33/1 SD |
| 3,989,244 | A | | 11/1976 | Wadina | |
| 3,993,305 | A | | 11/1976 | Nicholson | |
| 4,027,883 | A | | 6/1977 | Batori | |
| 4,082,270 | A | | 4/1978 | Josenhans | |
| 4,120,494 | A | | 10/1978 | Roe | |
| 4,151,990 | A | | 5/1979 | Josenhans | |
| 4,178,694 | A | | 12/1979 | Bonney | |
| 4,268,033 | A | | 5/1981 | Fontaine | |
| 4,531,732 | A | | 7/1985 | Harris | |
| 4,882,676 | A | | 11/1989 | Van De Kop et al. | |
| 5,183,254 | A | * | 2/1993 | Jones | 473/4 |
| 5,234,379 | A | | 8/1993 | Zotos | |
| 5,275,398 | A | | 1/1994 | Compton | |
| 5,338,262 | A | | 8/1994 | Hayes | |
| 5,401,215 | A | | 3/1995 | Pfost | |
| 5,520,581 | A | | 5/1996 | Mazzoli | |
| 5,653,035 | A | * | 8/1997 | Chen | 33/484 |
| 5,769,728 | A | * | 6/1998 | Kasino | 473/2 |
| 5,919,095 | A | | 7/1999 | Risner | |
| 6,761,643 | B2 | * | 7/2004 | Boatwright | 473/2 |

* cited by examiner

*Primary Examiner*—Mitra Aryanpour
(74) *Attorney, Agent, or Firm*—Womble Carlyle Sandridge & Rice, PLLC

(57) ABSTRACT

A device for calculating where a cue ball must cause an object billiard ball to strike the bumper of a billiards table in order to drive the object ball into a selected pocket of the billiards table of the type having two opposed end rails and two opposed side rails. The device includes a plotting board and a guide. The plotting board comprises a scaled playing table portion and at least one scaled mirror table portion having pocket positions formed thereon, wherein the mirror table adjoins at least one of the opposed end rails or opposed side rails and is a mirror image of the playing table portion. The plotter comprises a guide and an object ball arm, the object ball arm having a pocket guide end and an object end. When the guide is placed over a selected pocket position on the mirror table portion and the object ball end of the object ball arm is aligned with the object ball on the scaled playing table and the pocket guide end is aligned with the guide over the selected pocket position, the object ball arm will cross the scaled playing table at a point where the object ball must strike the bumper of the billiards table.

5 Claims, 9 Drawing Sheets

SHOT CALCULATOR FOR BILLIARDS

FIELD OF THE INVENTION

The present invention relates to the game of billiards, and, more particularly to a handheld device and method for calculating bank and kick shots using a mirror-image plotting technique.

BACKGROUND OF THE INVENTION

The game of billiards, of which the game of pool is one particular type of game, is a well known game of skill which has been played for hundreds of years in some form or fashion. The game is played by striking a cue ball with a cue stick, causing the cue ball to collide with another ball (the object ball) so as to drive the object ball into a selected pocket on the playing surface. Players accomplish this by employing one of two different shots utilizing the rails/cushions of the playing table.

When the cue ball is caused to strike the target ball directly, so that the target ball rebounds from a rail cushion into a selected pocket, the shot is referred to as a "bank" shot. If, however, the cue ball is caused to strike the rail first before subsequently striking the target ball, that is referred to as a "kick" shot. In either case, players of the game of billiards must develop an ability to understand and accurately judge angles so as to properly aim and execute each shot.

To achieve an acceptable level of proficiency in the game requires considerable practice. As this can be frustrating and unfruitful for beginners, and at times for even the more advanced players, numerous learning aids have been devised over the years to assist players in developing and enhancing their proficiency in the game.

Most of the learning aids that have been marketed, however, are complex and unwieldy. Many require that some type of gadget, mirror, or attachment be positioned on or around the actual playing table. As such, these devices are often prohibited from commercial playing tables. Further, since these aids must be used on a full-scale playing table, players who do not own their own tables are rarely able to use the devices for individual practice.

What is needed is a portable, handheld learning aid that overcomes the above problems and that can be used apart from an actual playing table, yet with considerable accuracy.

SUMMARY OF THE INVENTION

The present invention is directed to a portable, handheld device and method for calculating bank shots and kick shots on a conventional billiards, or pool, table.

One aspect of the present invention is directed to a device for calculating where a cue ball must cause an object billiard ball to strike the bumper of a billiards table in order to drive the object ball into a selected pocket of the billiards table. This is commonly known as a "bank" shot. The device includes a handheld plotting board and a plotter. The plotting board comprises a scaled playing table portion and a scaled mirror table portion. The scaled mirror table, which adjoins at least one of the opposed end rails or opposed side rails of the scaled playing table portion, has apertures that represent pocket positions on the scaled playing table portion, and hence, on the actual playing table. The plotter includes a guide and an object ball arm. When the guide is placed over a selected pocket position on the mirror table portion and the object ball arm is aligned with the object ball on the scaled playing table, the object ball arm will cross the scaled playing table rail/bumper at a point where the object ball must strike the bumper of the billiards table.

Optionally, a full-size rail ruler which corresponds to the scale on the scaled playing table portion may be provided for placement on the rail/bumper of the actual billiards table corresponding to the scale on the scaled playing table portion. This would assist a player in causing the object ball to strike the bumper at the calculated point on the billards table.

A second embodiment of the present invention is directed to a device for calculating where a cue ball must strike the bumper of a billiards table in order to rebound and strike an object ball, driving the object ball into a selected pocket of the billiards table. This is commonly known as a "kick" shot. This device also includes a plotting board and a plotter, similar to the board and plotter of the first embodiment. For this type of shot calculation, when the guide is placed over the selected pocket on the mirror table portion, the object ball arm is aligned with the object ball on the mirror table portion, and the cue ball arm is aligned with the cue ball on the playing table, the cue ball arm will cross the scaled playing table at the point where the cue ball must strike the bumper of the billiards table.

Another aspect of the present invention is directed to a method for determining where a cue ball must cause an object billiard ball to strike the bumper of a billiards table in order to drive the object ball into a selected pocket of the billiards table. On a template having a scaled playing table portion and at least one interconnected mirror table portion, the selected pocket is first plotted on the mirror table portion pocket. As those skilled in the mathematical arts will appreciate, this method may be drawn and practiced on graph paper, or the like. A line is next plotted between the selected pocket on the mirror table portion and the object billiard ball on the playing table portion. The line then crosses the end or side of the playing table portion at the point where the object ball must strike the bumper of the billiards table in order to rebound into the selected pocket.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
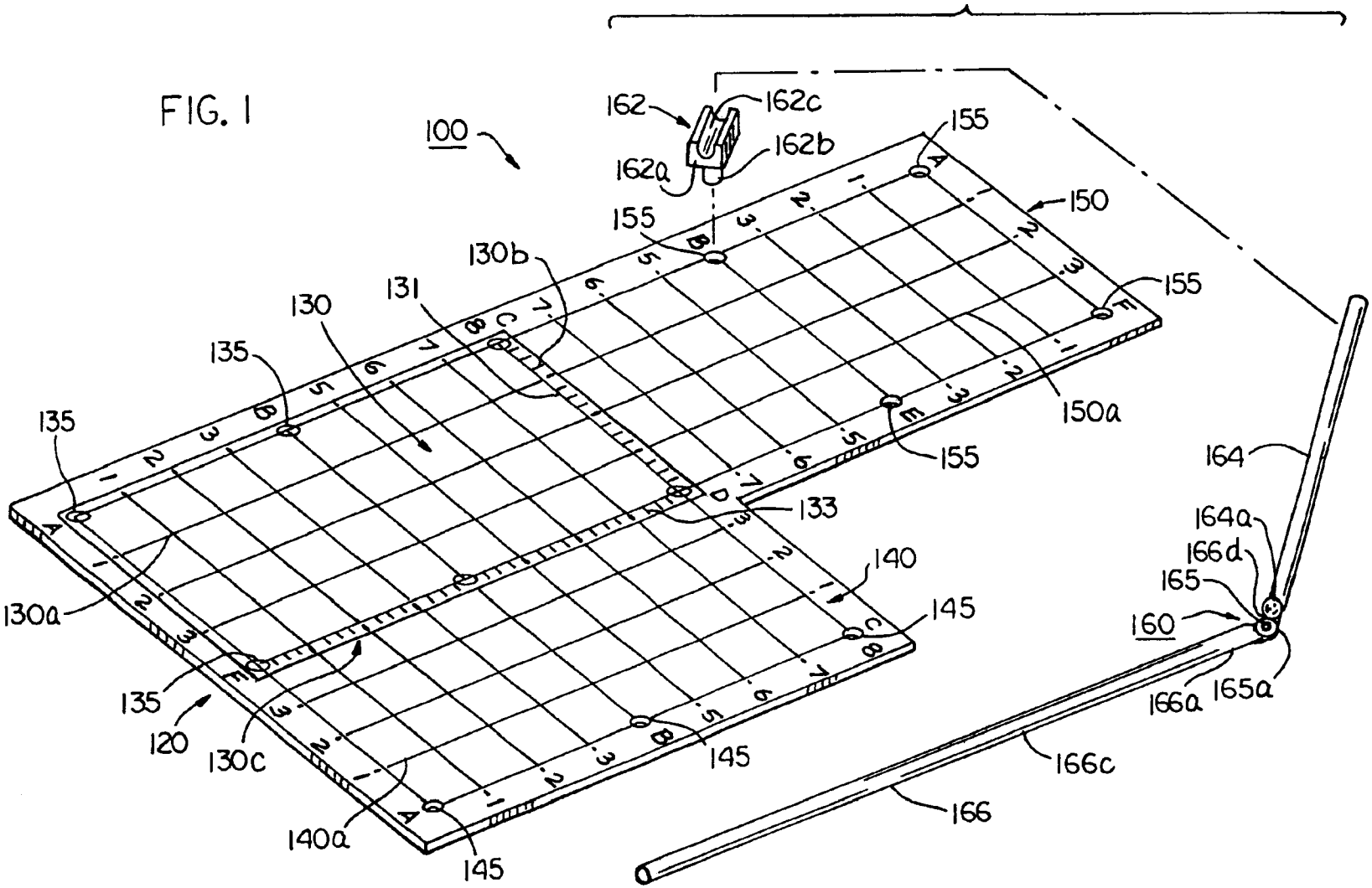
FIG. 1 is an exploded perspective view of the device of the present invention.

Referring to FIG. 1, the present invention is directed to a portable, handheld device for calculating bank shots and kick shots in the game of billiards. As used herein, "billiards" shall refer to any of several games played with hard balls that are driven with a cue on a cloth-covered table. Similarly, "pool" is a species of billiards, and refers to any of various games played on a pool (playing) table with one cue ball and 15 other balls that are driven into pockets.

One aspect of the present invention provides a device, shown generally as 100, for calculating where a cue ball must cause an object ball to strike the bumper of a billiards table in order to drive the object ball into a selected pocket on the billiards table. As used herein, the "object"or target, ball refers to a ball other than the cue ball which a player desires to drive into a selected pocket.

The device 100 comprises a plotting board 120 and a plotter 160. In one preferred embodiment, the plotting board 120 comprises a scaled playing table portion 130 and two scaled mirror table portions 140, 150. As will be explained in greater detail below, mirror table portion 140 will be used when calculating/playing bank shots or kick shots using either of the long/side rails of the playing table. Similarly, mirror table portion 150 will be used when calculating/playing bank shots or kick shots using either of the short/end rails of the playing table.

The table portions 130, 140, 150 comprising the device 100 are integrally formed from a single sheet of plastic, plexiglass, etc. that is relatively thin such that it is easily handled and is portable. The plotting board may be translucent, transparent, or opaque; i.e., the surface finish or color of the plotting board 120 is not important to the functionality or utility of the invention.

As shown in FIG. 1, a grid 130*a*, 140*a*, and 150*a* is etched, painted, or printed on each table portion so that each table portion is scaled with a 4×8 grid pattern with each area of the grid having an equal dimension. Additionally, scales 130*b*, 130*c* are etched, printed, or painted along two edges 131, 133 of the scaled playing table portion 130. The scales break down each of the larger grids along sides 131, 133 into 8 equal increments. As will be apparent to those skilled in the art, the size of the grids or the lengths of the increments are not limited hereto so long as they yield a desired level of accuracy when the device 100 is used to calculate shots.

Generally circular indicia 135 indicate the pocket positions of the actual playing table on the scaled playing table 130. On the mirror table portions 140, 150, round apertures 145, 155 are formed therethrough the table portions 140, 150 corresponding to the pocket 135 positions on the playing table. As shown in FIG. 1, there are four apertures 155 formed in mirror table portion 150 and three apertures 145 formed in mirror table portion 140, each representing the mirror image of a pocket position 135 on the scaled playing table portion 130.

The plotter 160 of the present invention comprises a guide 162 and an object ball arm 164. The guide 162 comprises a generally rectangular or square holder portion 162*a* and an integrally formed dowel 162*b* extending downwardly from the holder portion 162*a*; however, the shapes and relative dimensions of the plotter are not critical so long as their functionality is as described herein. As will be explained in greater detail below, the dowel 162*b* of the guide 162 is inserted into the selected mirrored pocket position on either mirror table portion 140 or mirror table portion 150. The holder portion 162*a* is dimensioned with a slot 162*c* to slideably engage the object ball arm 164. Accordingly, the slot 162*c* and the end 164*a* of the object ball arm are similarly dimensioned. The slot 162*c* permits the object ball arm 164 to slide within the slot 162*c* to accommodate the various shot calculations that a player may desire to complete. At the opposite end of the object ball arm 164 is a scaled circular indicia 164*a* representing the object ball.

In a second embodiment, the plotter 160 further comprises a cue ball arm 166 having an object ball end 166*a*. The object ball end 166*a* of the cue ball arm 166 is pivotally connected to the object end 164*a* of the object ball arm 164 at pivot point 165. A scaled circular indicia 165*a* at pivot point 165 represents the desired position of the cue ball at impact with the object ball in executing a calculated shot. A line 166*c* is etched, painted, or printed along the longitudinal center of the cue ball arm 166 to assist a player in aligning the center of the cue ball arm 166 with the actual cue ball position on the scaled playing table portion 130.

Figure 2:
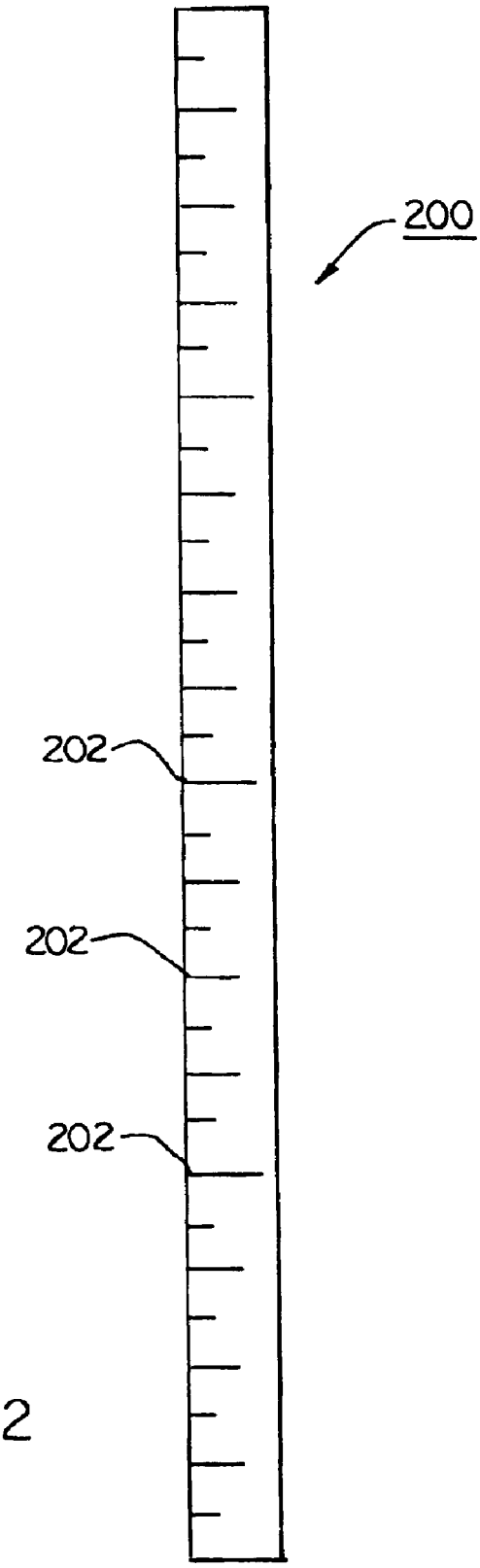
FIG. 2 is illustrative of an exemplary rail ruler for use in conjunction with the device of the present invention.

Turning now to FIG. 2, the present invention may further include a scale 200 for placement on the actual billiards or pool table. The scale 200 corresponds to the scaled playing table portion 150 to assist a player in completing the actual shot during game play. The scale 200 may be provided in various lengths, e.g., 36 inches, 42 inches, and 48 inches. These lengths represent the distances between pocket positions on an end rail or side rail for billiards and pool tables of standard construction. Similar to the grid of the device 100, the scale 200 is divided into eight equal increments 202.

Figure 3:
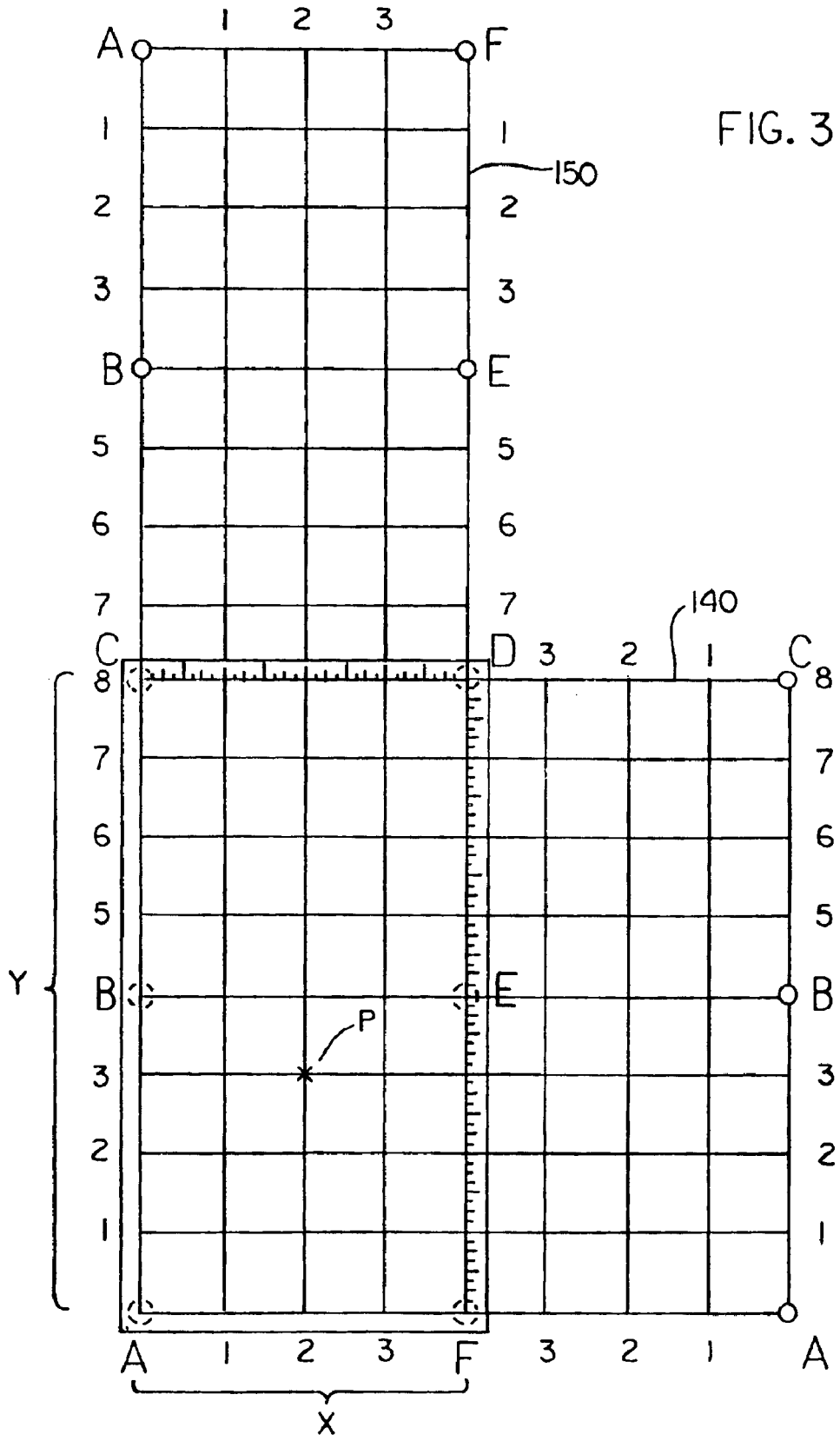
FIG. 3 is a diagram illustrating an exemplary coordinate convention for the present invention.

Having described the construction of the device 100 of the present invention, the use of the device 100 in calculating exemplary bank shots and kick shots will now be explained. To aid in understanding the numbering and coordinate system of the present invention, turn now to FIG. 3 where a top view of the device 100 is shown. While one possible numbering or labeling of the coordinate system of the present invention is illustrated, any logical coordinate convention may be used. Referring to the scaled playing table portion 130, the table 130 is divided into eight equal increments lengthwise and four equal increments widthwise. As viewed from the top, and for purposes of understanding the operation of the device and method of the present invention, a standard X-Y coordinate system will be used; i.e., the point labeled as 'P' on the playing table portion 130 is represented by the coordinates X2 and Y3. Also shown on the scaled playing table portion are the six pocket positions, labeled A through F. It is also seen that from FIG. 3 that mirror playing tables 140 and 150 are simply mirror images of the scaled playing table portion 130. As constructed, the device 100 of the present invention permits the player to calculate bank and kick shots from the upper and right side rails. While the device could be enlarged to include mirror table portions interconnected to the bottom and left side rails, the device may also be turned 180 degrees for calculations involving shots off of those respective rails/bumpers.

While not exhaustive, the following examples are illustrative of bank shot and kick shot calculations using the device and method of the present invention:

EXAMPLE 1

End Rail Bank Shot

Figure 4:
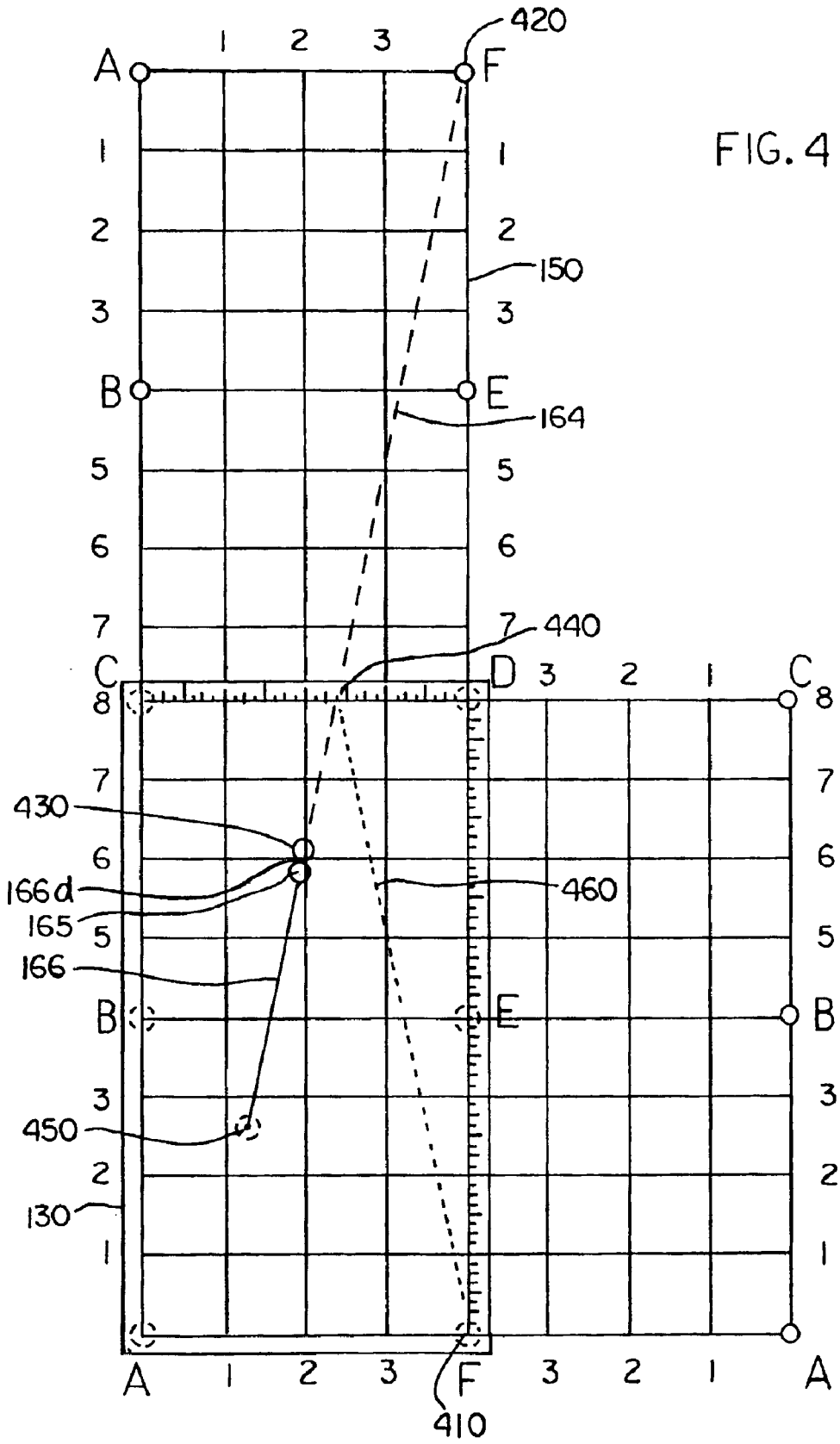
FIG. 4 is a schematic illustration for one type of end rail bank shot calculated with the device of the present invention.

Turning now to FIG. 4, the first exemplary shot is an end rail bank shot to pocket 'F' on the scaled playing table portion 130, shown as position 410. The dowel 162*b* of the guide 162 is inserted into corresponding mirror pocket 'F', shown as position 420 on mirror table 150. End 164*a* of the object ball arm is then inserted into the slot 162*c* of the guide 162. The object ball arm 164 is then aligned with the object ball on the scaled playing table portion 130, shown as position 430. As shown in FIG. 4, the object ball position is approximately at coordinates X2, Y6 ⅛. This represents the position of the object ball on the actual billiards table. Note that the center of the object ball arm 164 crosses the scale 150 on the end rail at approximately X2 ⅜. This is the position that the actual object ball must strike in order to rebound into the corner pocket 'F', position 410. As further shown, the cue ball arm 166 is pivotally connected to the object ball arm 164 at the pivot point 165 of the plotter 160 and aligned with the actual cue ball position of about X1 ⅜, Y2 ⅝ (position 450). As also shown in FIG. 4, the approximate point of impact of the cue ball with the object ball is formed on the cue ball arm end 16*a* as point 166*d*. This assists the player in judging where the cue ball should impact the object ball so that the object ball rebounds into the desired pocket.

When calculated in accordance therewith, the object ball should rebound from bumper position 440 into pocket 'F' 410 as indicated by the dotted line 460.

EXAMPLE 2

End Rail Bank Shot

Figure 5:
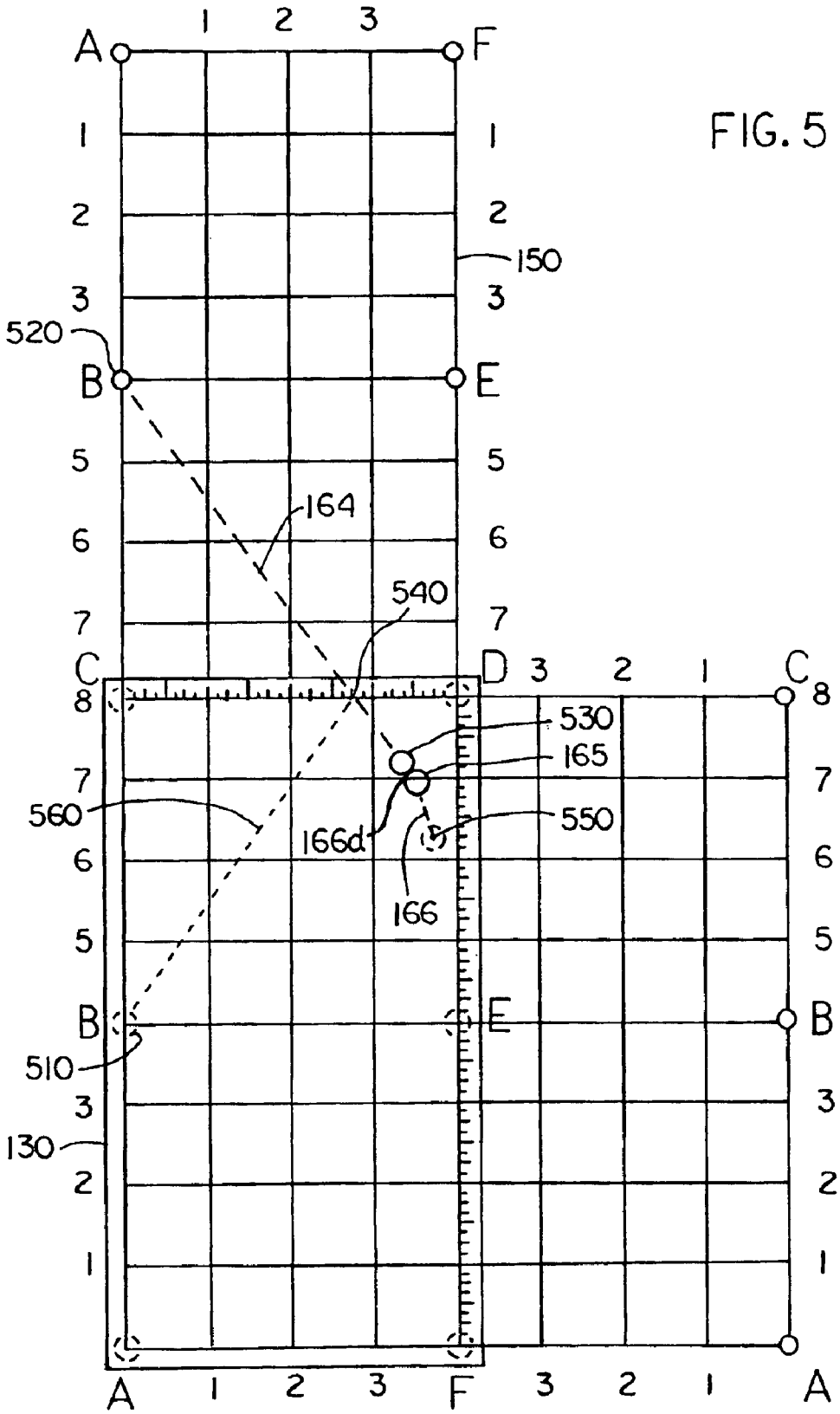
FIG. 5 is a schematic illustration for a second type of end rail bank shot calculated with the device of the present invention.

Turning now to FIG. 5, another example of an end rail bank shot is shown, whereby the desired pocket position is pocket 'B' (position 510). The dowel 162*b* of the guide 162 is inserted into corresponding pocket 'B', shown as position 520 on mirror table 150. End 164*a* of the object ball arm is then inserted into the slot 162*c* of the guide 162. The object ball arm 164 is then aligned with the object ball on the scaled playing table portion 130, shown as position 530. As shown in FIG. 5, the object ball position is approximately at coordinates X3 ⅜, Y7 ¼. Again, this represents the position of the object ball on the actual billiards table. Again, note that the center of the object ball arm 164 crosses the scale 150 on the end rail at approximately X2 ⅞, Y8. This is the rail position that the actual object ball must strike in order to rebound into the side pocket 'B', position 510. The cue ball arm 166 is pivotally connected to the object ball arm 164 at the pivot point 165 of the plotter 160 and aligned with the actual cue ball position of about X3 ¾, Y6 ⅜ (position 550). As also shown in. FIG. 5, the approximate point of impact of the cue ball with the object ball is formed on the cue ball arm end 166*a* as point 166*d*. When calculated in accordance therewith, the object ball should rebound from bumper position 540 into pocket B, position 510 as indicated by the dotted line 560.

EXAMPLE 3

Side Rail Bank Shot

Figure 6:
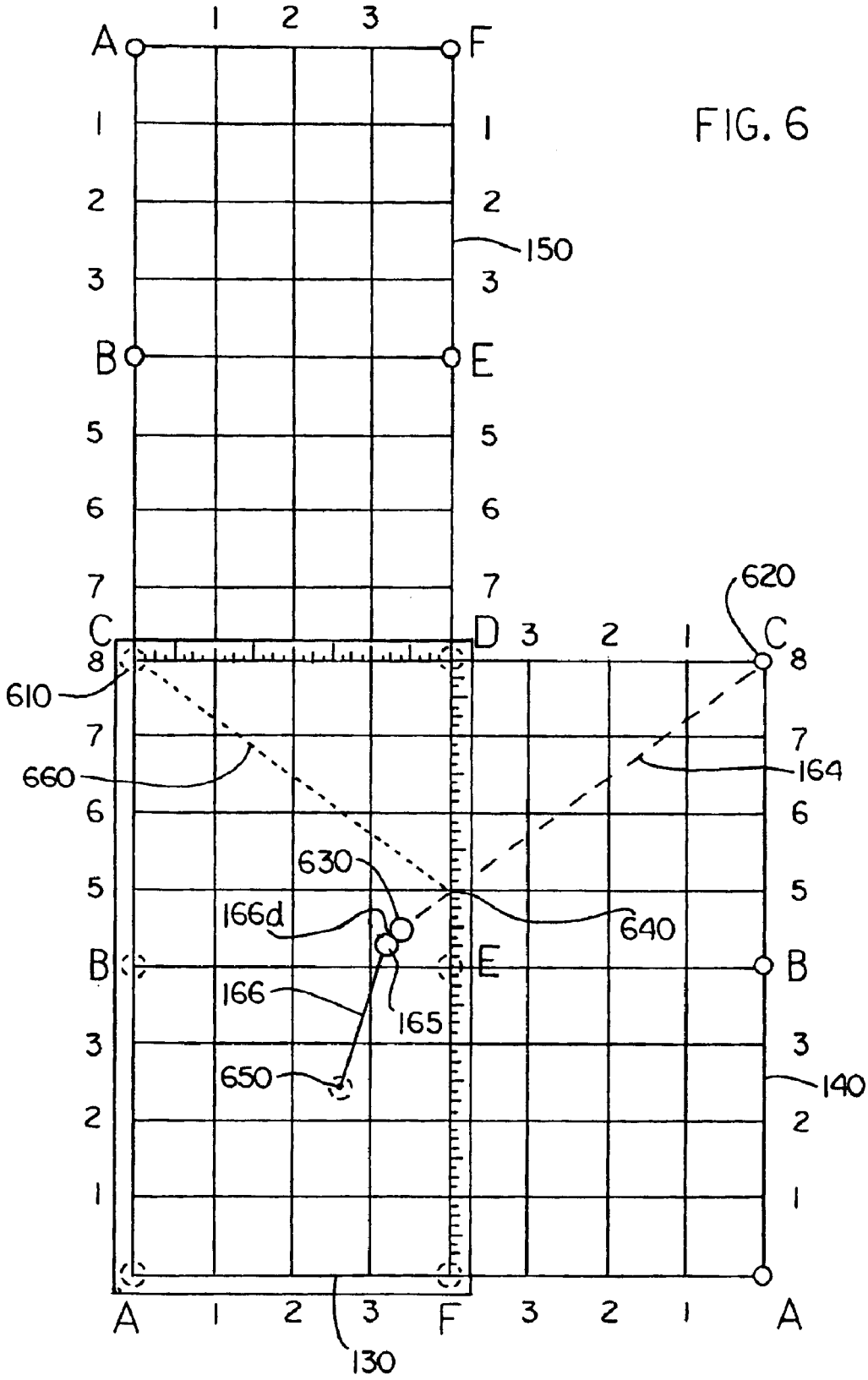
FIG. 6 is a schematic illustration for one type of side rail bank shot calculated with the device of the present invention.

Turning now to FIG. 6, the first exemplary side rail shot is shown whereby the desired pocket position is pocket 'C' (position 610) on the scaled playing table portion 130, is shown as position 610. The dowel 162*b* of the guide 162 is inserted into corresponding pocket 'C', shown as position 620 on mirror table 140. End 164*a* of the object ball arm is then inserted into the slot 162*c* of the guide 162. The object ball arm 164 is then aligned with the object ball on the scaled playing table portion 130, shown as position 630. As shown in FIG. 6, the object ball position is approximately at coordinates X3 ⅜, Y4 ½. This represents the position of the object ball on the actual billiards table. Note that the center of the object ball arm 164 crosses the scale 150 on the side rail at approximately X4 ⅞, Y5 position 640. This is the rail position that the actual object ball must strike in order to rebound into the corner pocket 'C', position 610. As further shown, the cue ball arm 166 is pivotally connected to the object ball arm 164 at the pivot point 165 of the plotter 160 and aligned with the actual cue ball position of about X2 ⅝, Y2 ½ (position 650). As also shown in FIG. 6, the approximate point of impact of the cue ball with the object ball is formed on the cue ball arm end 166*a* as point 166*d*. When calculated in accordance therewith, the object ball should rebound from bumper position 640 into pocket 'C' 610 as indicated by the dotted line 660.

EXAMPLE 4

Side Rail Bank Shot

Figure 7:
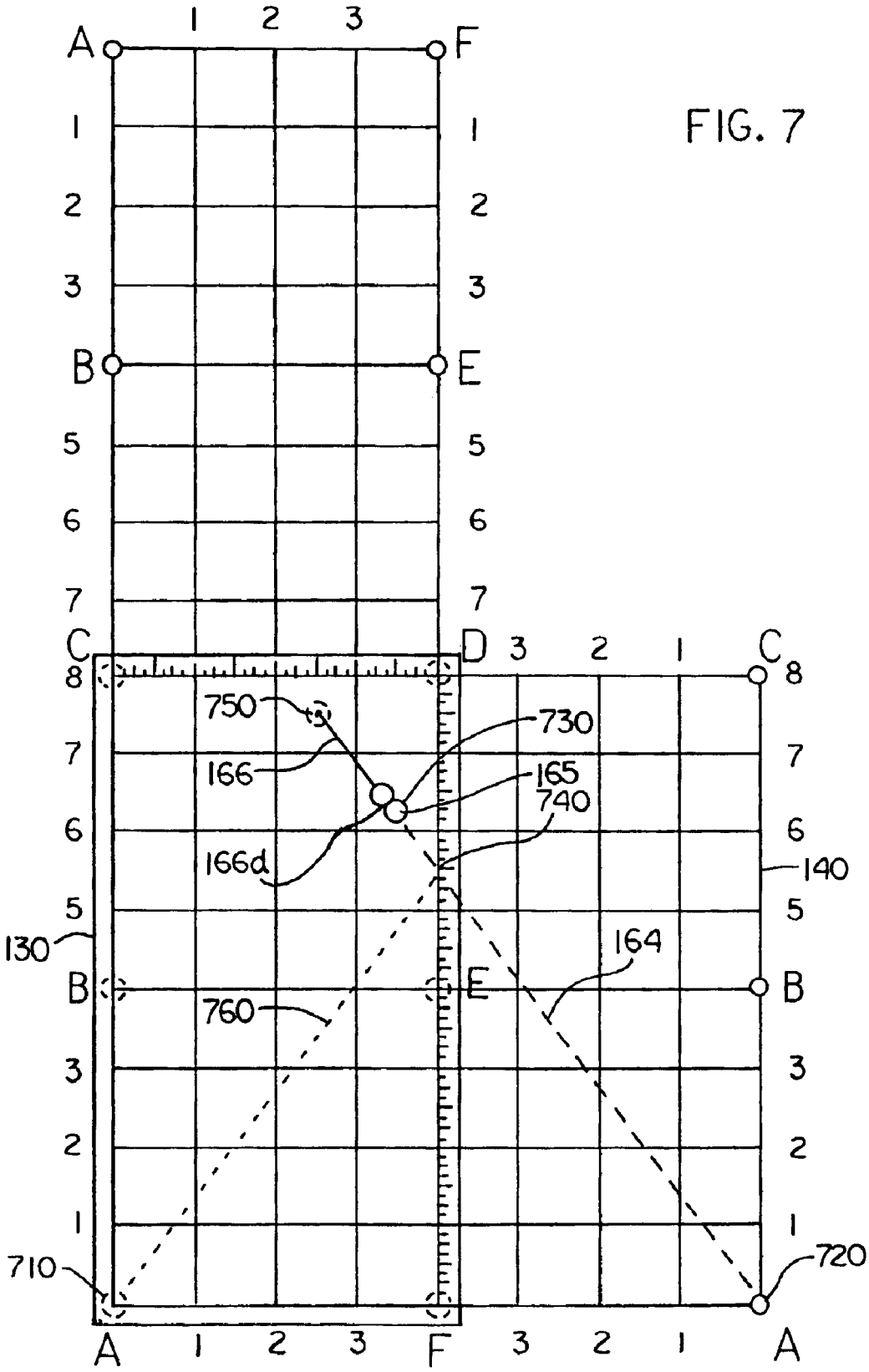
FIG. 7 is a schematic illustration for a second type of side rail bank shot calculated with the device of the present invention.

Turning now to FIG. 7, another exemplary side rail bank shot is shown whereby the desired pocket position is pocket 'A' (position 710). The dowel 162*b* of the guide 162 is inserted into corresponding pocket 'A', shown as position 720 on mirror table 140. End 164*a* of the object ball arm is then inserted into the slot 162*c* the guide 162. The object ball arm 164 is then aligned with the object ball on the scaled playing table portion 130, shown as position 730. As shown in FIG. 7, the object ball position is approximately at coordinates X3 ½, Y6, ¼. This represents the position of the object ball on the actual billiards table. Note that the center of the object ball arm 164 crosses the scale 150 on the side rail at approximately X4, Y 5⁹⁄₁₆, position 740. This is the rail position that the actual object ball must strike in order to rebound into the corner pocket 'A', position 710. As further shown, the cue ball arm 166 is pivotally connected to the object ball arm 164 at the pivot point 165 of the plotter 160 and aligned with the actual cue ball position of about X2 ½, Y7 ⅝ (position 750). As also shown in FIG. 7, the approximate point of impact of the cue ball with the object ball is formed on the cue ball arm end 166*a* as point 166*d*. When calculated in accordance therewith, the object ball should rebound from bumper position 740 into pocket 'A' 710 as indicated by the dotted line 760.

EXAMPLE 5

Side Rail Kick Shot

Figure 8:
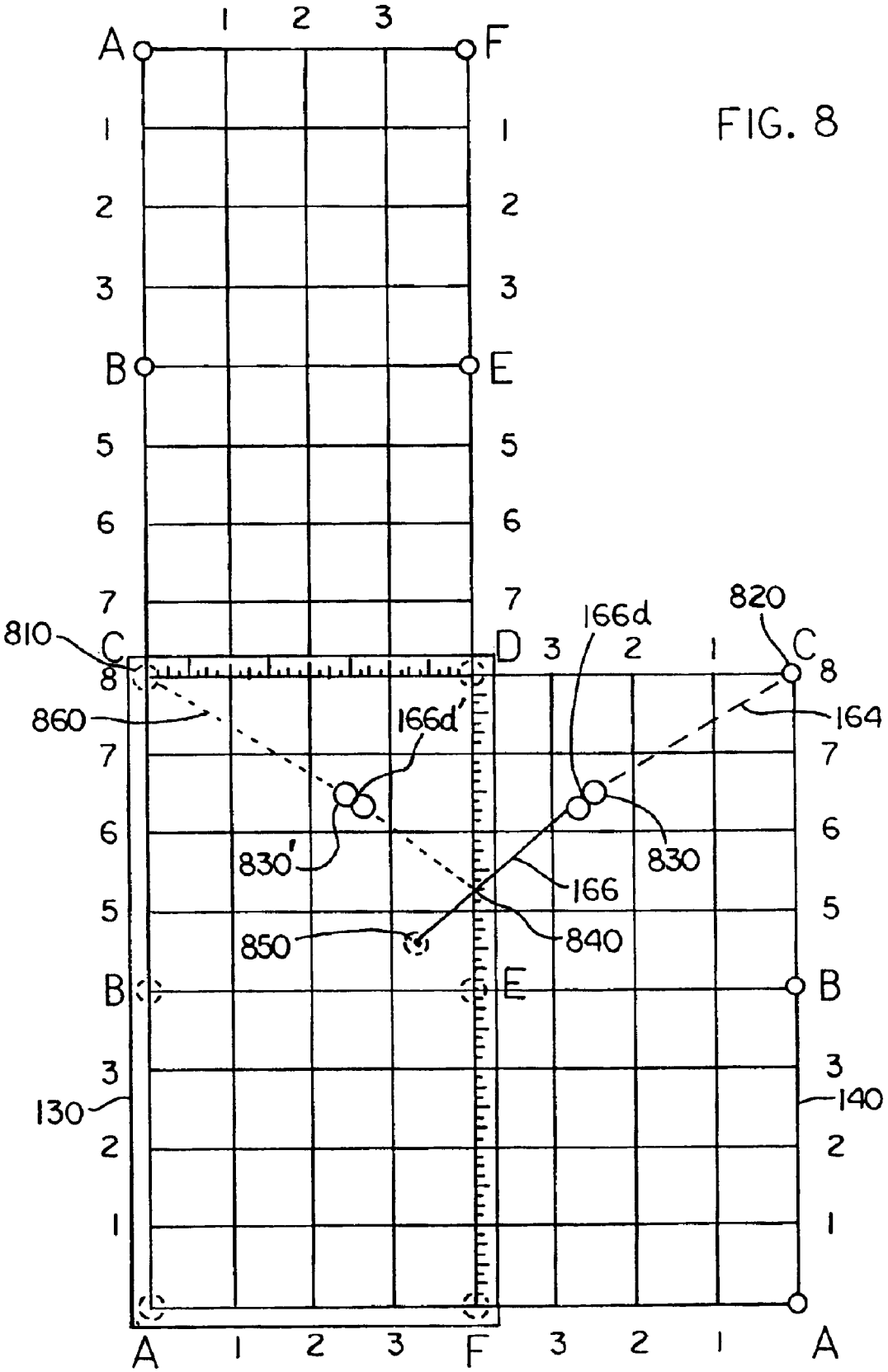
FIG. 8 is a schematic illustration for one type of kick shot calculated with the device of the present invention.

Turning now to FIG. 8, a first exemplary side rail kick shot is shown whereby the desired pocket position is corner pocket 'C' (position 810) on the scaled playing table portion 130. The dowel 162*b* of the guide 162 is inserted into corresponding pocket 'C', shown as position 820 on mirror table 140. End 164*a* of the object ball arm is then inserted into the slot 162*c* of the guide 162. The object ball arm 164 is then aligned on mirror table portion 140, shown as position 830, with a mirror image of the object ball(position 830') as it appears on the scaled playing table portion 130. As shown in FIG. 8, the object ball position is approximately at coordinates X2 ½, Y6 ½ on both the scaled playing table portion and on the mirror table portion 140. This represents the position of the object ball on the actual billiards table. Next, the cue ball arm is pivotally connected to the object arm 164 at the pivot point 165 of the plotter 160 and aligned with the actual cue ball position of about X3 ³⁄₁₈, Y4 ⅝ (position 850). For a kick shot, note that the center of the cue ball arm 166 crosses the scale 150 on the side rail at approximately X4, Y5 ³⁄₁₆, position 840. This is the rail position that the cue ball must strike the side rail in order to rebound, striking and driving the object ball into the corner pocket 'C', position 810. As also shown in FIG. 8, the approximate point of impact of the cue ball with the object ball is formed on the cue ball arm end 166*a* as point 166*d*, which mirrors the required impact on the playing table portion 130 (position 166*d*'). When calculated in accordance therewith, the cue ball should rebound from the bumper position 840 into the object ball and the object ball should rebound from the cue ball and into pocket 'C' (position 810) as indicated by the dotted line 860.

EXAMPLE 6

End Rail Kick Shot

Figure 9:
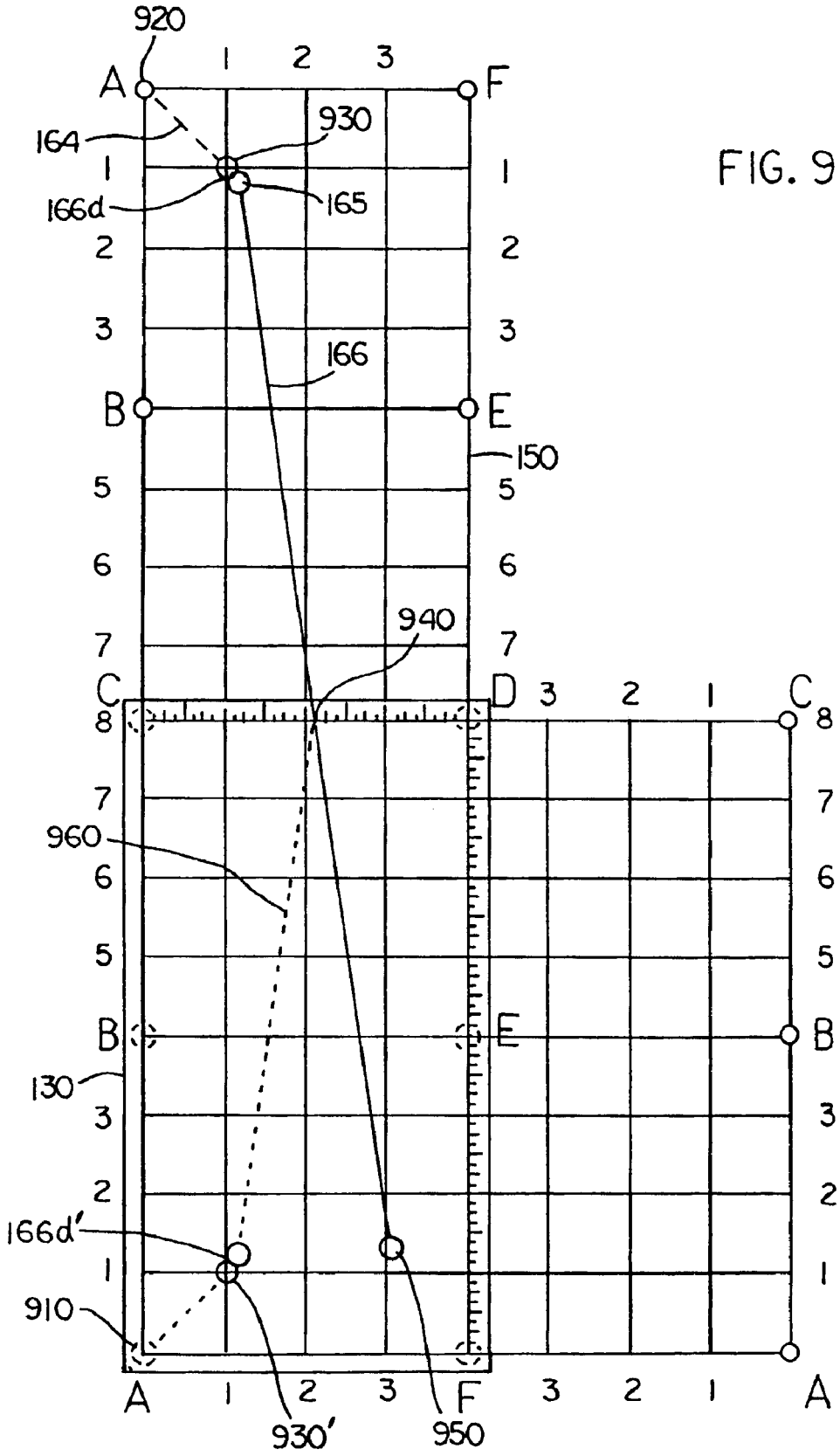
FIG. 9 is a schematic illustration for a second type of kick shot calculated with the device of the present invention.

Turning now to FIG. 9, an exemplary end rail kick shot is shown whereby the desired pocket position is corner pocket 'A' (position 910) on the scaled playing table portion 130. The dowel 162*b* of the guide 162 is inserted into corresponding pocket 'A', shown as position 920 on mirror table 150. End 164*a* of the object ball arm is then inserted into the slot 162*c* of the guide 162. The object ball arm 164 is then aligned on mirror table portion 150, shown as position 930, with a mirror image of the object ball (position 930') as it appears on the scaled playing table portion 130. As shown in FIG. 9, the object ball position is approximately at coordinates X1, Y1 on both the scaled playing table portion and on the mirror table portion 150. This represents the position of the object ball on the actual billiards table. Next, the cue ball arm 166 is pivotally connected to the object arm 164 at the pivot point 165 of the plotter 160 and aligned with the actual cue ball position of about X3, Y1 ⅜ (position 950). For a kick shot, note that the center of the cue ball arm 166 crosses the scale 150 on the end rail at approximately X2 ⅛, Y8 (position 940). This is the rail position that cue ball must strike the end rail in order to rebound, striking and driving the object ball into the corner pocket 'A', position 910. As also shown in FIG. 9, the approximate point of impact of the cue ball with the object ball is formed on the cue ball arm end 166*a* as point 166*d*, which mirrors the required impact on the playing table portion 130 (position 166*d*'). When calculated in accordance therewith, the cue ball should rebound from the bumper position 940 into the object ball and the object ball should rebound from the cue ball and into pocket 'A' 910 as indicated by the dotted line 960.

Although the present invention has been described with exemplary constructions, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A device for calculating where a cue ball must cause an object billiard ball to strike the bumper of a billiards table in order to drive the object ball into a selected pocket of the billiards table of the type having two opposed end rails and two opposed side rails, comprising:

(a) a plotting board comprising:
  (i) a scaled playing table portion;
  (ii) at least one scaled mirror table portion having pocket positions formed thereon, wherein the at least one mirror table adjoins at least one of the opposed end rails or opposed side rails and is a mirror image of the playing table portion;

(b) a plotter comprising:
  (i) a guide;
  (ii) an object ball arm, the object ball arm having a pocket guide end and an object end;

(c) wherein when the guide is placed over a selected pocket position on the mirror table portion and the object ball end of the object ball arm is aligned with the object ball on the scaled playing table and the pocket guide end is aligned with the guide over the selected pocket position, the object ball arm will cross the scaled playing table at a point where the object ball must strike the bumper of the billiards table.

2. The device of claim 1 further including a cue ball arm having an object end, the object end of the cue ball arm being pivotally connected to the object end of the object ball arm, wherein when the cue ball arm is aligned with the cue ball on the playing table, the cue ball arm indicates where the object ball must be struck by the cue ball.

3. The device of claim 1 further including a scale for placement on the bumper of the billiards table, the scale corresponding to the scaled playing table to assist a player in causing the object ball to strike the bumper at a desired point on the billards table.

4. A device for calculating where a cue ball must strike the bumper of a billiards table in order to rebound and strike an object ball, driving the object ball into a selected pocket of the billiards table of the type having two opposed end rails and two opposed side rails, comprising:

(a) a plotting board comprising:
  (i) a scaled playing table portion;
  (ii) at least one scaled mirror table portion having pocket positions formed thereon, wherein the at least one mirror table adjoins at least one of the opposed end rails or opposed side rails and is a mirror image of the playing table portion;

(b) a plotter comprising:
  (i) a guide;
  (ii) an object ball arm, the object ball arm having a pocket guide end and an object end;
  (iii) a cue ball arm, the cue ball arm having one end pivotally connected to the object end of the object ball arm, (c) wherein when the guide is placed over the selected pocket on the mirror table portion, the object ball end of the object ball arm is aligned with the object ball on the mirror table portion, and the cue ball arm is aligned with the cue ball on the playing table, the cue ball arm will cross the scaled playing table at the point where the cue ball must strike the bumper of the billiards table.

5. The device of claim 4 further including a scale for placement on the bumper of the billiards table, the scale corresponding to the scaled playing table to assist a player in causing the cue ball to strike the bumper at a desired point on the billards table.

* * * * *